US011472607B2

(12) United States Patent
Hu et al.

(10) Patent No.: US 11,472,607 B2
(45) Date of Patent: Oct. 18, 2022

(54) PORTABLE AIRTIGHT BOX AND BOX COVER THEREOF

(71) Applicant: Ningbo Shijia Cleaning Tools Co., Ltd., Zhejiang (CN)

(72) Inventors: Hui Hu, Ningbo (CN); Siwen Wang, Zhejiang (CN)

(73) Assignee: Ningbo Shijia Cleaning Tools Co., Ltd.

( * ) Notice: Subject to any disclaimer, the term of this patent is extended or adjusted under 35 U.S.C. 154(b) by 0 days.

(21) Appl. No.: 17/351,934

(22) Filed: Jun. 18, 2021

(65) Prior Publication Data

US 2022/0297898 A1 Sep. 22, 2022

(51) Int. Cl.
*B65D 43/02* (2006.01)

(52) U.S. Cl.
CPC .. *B65D 43/022* (2013.01); *B65D 2543/00194* (2013.01); *B65D 2543/00231* (2013.01); *B65D 2543/00518* (2013.01); *B65D 2543/00546* (2013.01); *B65D 2543/00972* (2013.01)

(58) Field of Classification Search
CPC ..... B65D 43/022; B65D 2543/00194; B65D 2543/00231; B65D 2543/00518; B65D 2543/00546; B65D 2543/00972
USPC ..... 220/234
See application file for complete search history.

(56) References Cited

U.S. PATENT DOCUMENTS

2020/0255189 A1* 8/2020 Liu ..... B65D 43/0204

FOREIGN PATENT DOCUMENTS

CN 201420298125.2 5/2015
CN 201720629692.5 1/2018

* cited by examiner

*Primary Examiner* — Valentin Neacsu
*Assistant Examiner* — Eric C Baldrighi

(57) ABSTRACT

A box cover for a portable airtight box, comprising an upper cover, a lower cover, a sliding plate, a reset spring, a pinching member, a lower cover plate, and a sealing ring, wherein the upper cover is fixedly connected to the lower cover, an accommodating space is formed between the upper cover and the lower cover, and the sliding plate is movably arranged within the accommodating space, wherein the reset spring is disposed between the sliding plate and the lower cover, wherein the sliding plate is capable of moving upward relative to the lower cover, wherein the pinching member is movably arranged on the upper cover, and the pinching member abuts against the sliding plate, wherein the lower cover plate is movably arranged at outer bottom of the lower cover, and the lower cover plate is fixedly connected with the sliding plate.

13 Claims, 2 Drawing Sheets

PORTABLE AIRTIGHT BOX AND BOX COVER THEREOF

TECHNICAL FIELD

This invention generally relates to the technical field of airtight boxes, and more particularly, to a portable airtight box and a box cover thereof.

BACKGROUND

A fresh-keeping airtight box is a common storage container used in people's daily lives, being used to store different types of food to keep them fresh and healthy. In a prior art, Chinese patent 201420298125.2 discloses a push-button airtight box and a box cover thereof, and Chinese patent 201720629692.5 also discloses a storage container and a container cover thereof. Both the aforesaid two patents disclose effective sealing of a container by using a sealing element controlled by a push-button elastic mechanism such that a tight contact between the sealing element and the inner wall surface of the container is achieved. However, shortcomings of the aforesaid technical solutions such as complex design and difficult assembly of the push-button elastic mechanism inevitably exist.

Therefore, it is urgent for those skilled in the art to improve the prior technical solutions.

SUMMARY

The purpose of the present invention is to provide a portable airtight box and a box cover, which have simple and reasonable structures and can be conveniently operated.

To achieve the above purpose, the present invention adopts the following technical solution: a box cover of an airtight box comprises an upper cover, a lower cover, a sliding plate, a reset spring, a pinching member, a lower cover plate and a sealing ring, wherein the upper cover is fixedly connected with the lower cover, an accommodating space is formed between the upper cover and the lower cover, and the sliding plate is movably arranged within the accommodating space, wherein the reset spring abuts between the sliding plate and the lower cover such that the sliding plate always possesses a motion tendency of moving upward relative to the lower cover, wherein the pinching member is movably arranged on the upper cover, and the pinching member abuts against the sliding plate, wherein the lower cover plate is movably arranged at the outer bottom of the lower cover, and the lower cover plate is fixedly connected with the sliding plate, wherein the sealing ring is fixedly sleeved on the outer edge of the lower cover plate and is configured to be a necking shape from top to bottom, wherein the lower cover is provided with a squeezing portion, which is matched with the inner wall of the sealing ring in a squeezing manner, wherein when the pinching member is pinched, the sliding plate and the lower cover plate are propelled by the pinching member to move downward relative to the lower cover, and at this point, the squeezing portion stops squeezing the sealing ring, thus enabling the sealing ring to separate from the inner wall of the box body of the airtight box, wherein when the pinching member is released, the sliding plate and the lower cover plate are propelled by the reset spring to move upward relative to the lower cover, and at this point, the squeezing portion 221 starts squeezing the sealing ring, thus making the sealing ring abut against the inner wall of the box body 1 of the airtight box.

In another embodiment of the present invention, the pinching member is a pinching key, and the pinching key is horizontally movably arranged on the upper cover.

In another embodiment of the present invention, the pinching member comprises two pinching keys, and the two pinching keys are oppositely arranged on the upper cover.

In another embodiment of the present invention, the upper cover is provided with a pinching groove, and the two pinching keys are arranged within the pinching groove.

In another embodiment of the present invention, one pinching key is provided with an insertion hole, and the other pinching key is provided with an insertion column matched with the insertion hole. The insertion column is movably inserted into the insertion hole.

In another embodiment of the present invention, a key spring is arranged to abut between the two pinching keys.

In another embodiment of the present invention, the bottom of the pinching key is provided with a first inclined surface, and the upper surface of the sliding plate is provided with a second inclined surface which abuts against the first inclined surface. When the pinching member is pinched, the pinching member propels the sliding plate to move downward through the interaction of the first inclined surfaces and the second inclined surfaces.

In another embodiment of the present invention, the bottom of the pinching key extends into the accommodating space, and the middle portion of the pinching key is provided with an avoiding groove matched with the upper cover.

In another embodiment of the present invention, the lower cover plate is provided with a clamping block, which passes through the lower cover and is fixed with the sliding plate in a clamping manner.

In another embodiment of the present invention, the squeezing portion is a squeezing inclined surface arranged on the outer wall of the lower cover.

In another embodiment of the present invention, the sealing ring and the lower cover plate are fixed in a split-type sleeving manner or are integrally molded.

An airtight box comprising a box body and a box cover matched with the box body.

In another embodiment of the present invention, when the box body and the box cover are connected, an annular region is formed between the lower cover and the box body. When the pinching member is pinched, the outer edge of the sealing ring exits from the annular region, and when the pinching member is released, the outer edge of the sealing ring extends into the annular region.

Compared with the prior art, the present invention has the following advantages: The box cover of the portable airtight box of the present invention is provided with a pinching member and a sliding plate. The pinching member abuts against the sliding plate to form a linkage structure. The lower cover plate fixedly connected with the sliding plate is arranged at the lower portion of the lower cover, the sealing ring is sleeved on the outer periphery of the lower cover plate, and a squeezing portion for squeezing the inner wall of the sealing ring is arranged on the lower cover. During use, when the pinching member is pinched, the squeezing portion releases the sealing ring, so that the sealing ring is separated from the inner wall of the box body. At the point, the box cover can be opened. Contrarily, when the pinching member is released, the squeezing portion starts squeezing the sealing ring such that the sealing ring is in tight contact with the box body. At this point, the box body is effectively sealed. Compared with the prior art, the present invention has a reasonable and simple structure and achieves low manufacturing cost, easy assembly and convenient operation.

BRIEF DESCRIPTION OF THE DRAWINGS

In FIGS. 1-3: 1-Box Body, 2-Box Cover, 21-Upper Cover, 211-Pinching Groove, 22-Lower Cover, 221-Squeezing Portion, 23-Sliding Plate, 231-The Second Inclined Surface, 24-Reset Spring, 25-Pinching Key, 251-Insertion Hole, 252-Insertion Column, 253-The First Inclined Surface, 254-Avoiding Groove, 26-Lower Cover Plate, 261-Clamping Block, 27-Sealing Ring, 28-Key Spring, 3-Annular Region.

DETAILED DESCRIPTION

Figures and detailed embodiments are combined hereinafter to further elaborate the technical solution of the present invention.

Embodiment 1

Figure 1:
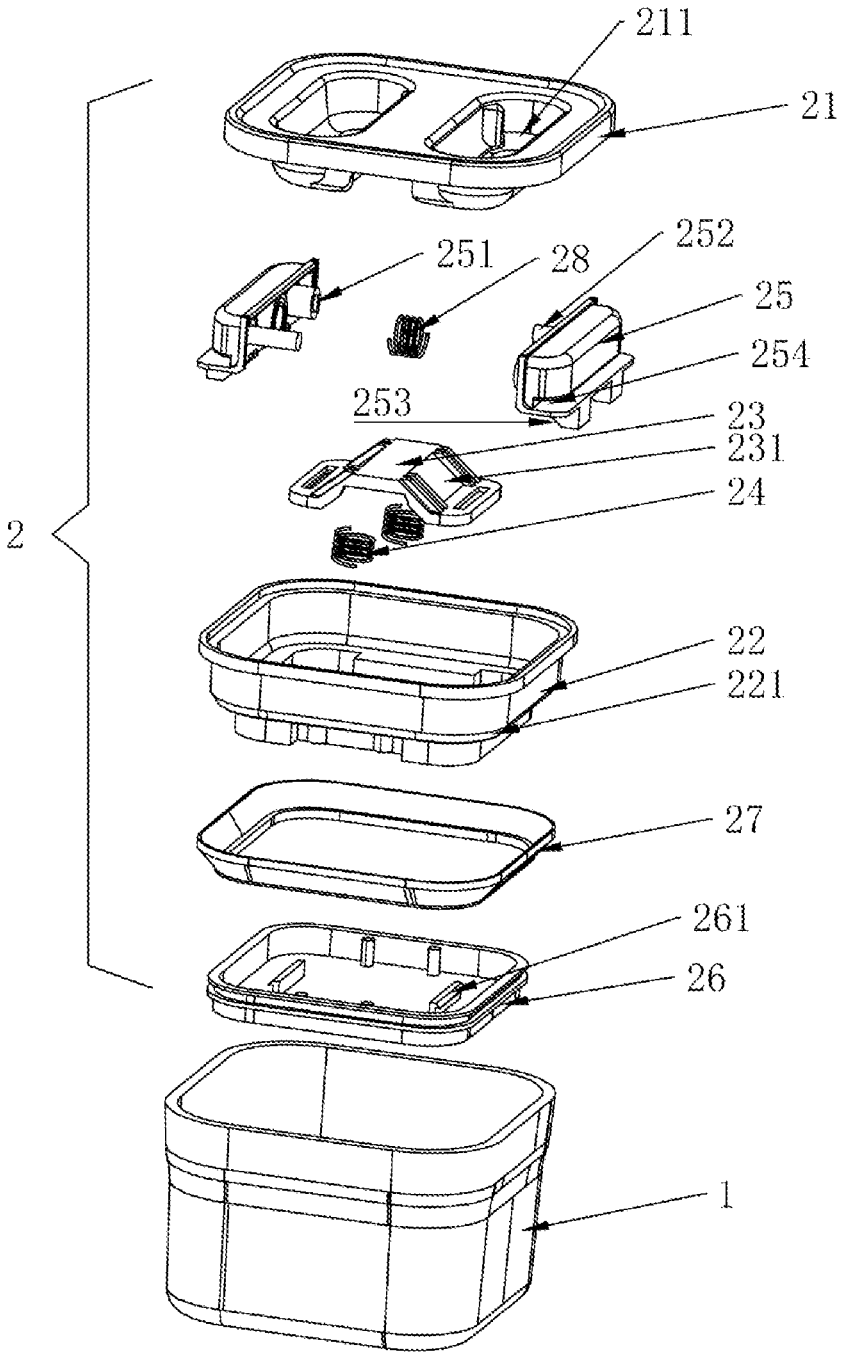
FIG. 1 is a conceptual diagram illustrating an explosive view of the airtight box of the present invention.
Figure 2:
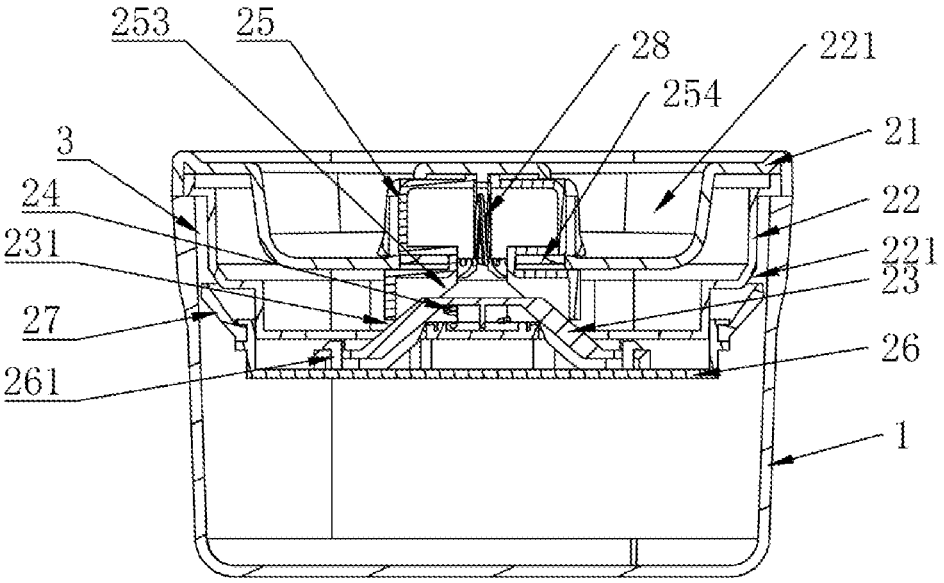
FIG. 2 is a conceptual diagram illustrating an exemplary structure when the box cover of the airtight box of the present invention is in an open state.
Figure 3:
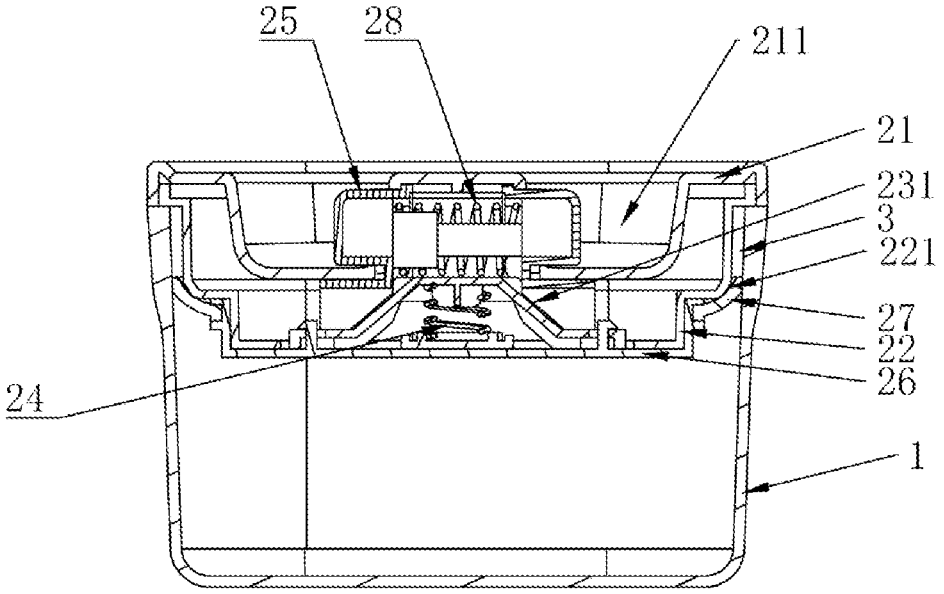
FIG. 3 is a conceptual diagram illustrating an exemplary structure when the box cover of the airtight box of the present invention is in a closed state.

As shown in FIGS. 1-3, a portable airtight box comprises a box cover 2, wherein the box cover 2 further comprises an upper cover 21, a lower cover 22, a sliding plate 23, a reset spring 24, a pinching member, a lower cover plate 26 and a sealing ring 27. The upper cover 21 is fixedly connected with the lower cover 22, an accommodating space is formed between the upper cover 21 and the lower cover 2, and the sliding plate 23 is movably arranged within the accommodating space. In this embodiment, the sliding plate 23 is configured to be arch-shaped. The middle portion of the sliding plate 23 arches upward to reserve space for installing the reset spring 24. The reset spring 24 abuts between the sliding plate 23 and the lower cover 22 such that the sliding plate 23 always possesses a motion tendency of moving upward relative to the lower cover 22. In this embodiment, the number of the reset springs 24 is two. The two reset springs 24 are arranged in parallel between the sliding plate 23 and the lower cover 22, thereby increasing the elastic restoring force for allowing the slide plate 23 to reset quickly.

The pinching member is movably arranged on the upper cover 21, and the pinching member abuts against the sliding plate 23. In this embodiment, the pinching member is a pinching key 25, and the pinching key 25 is horizontally movably arranged on the upper cover 21. Preferably, the pinching member comprises two pinching keys 25, wherein the two pinching keys 25 are oppositely arranged on the upper cover 21. The upper cover 21 is provided with a pinching groove 211 capable of allowing a user's fingers to extend into, and the two pinching keys 25 are arranged in the pinching groove 211. The aforesaid design allows a user to pinch the pinching keys 25 together by extending his fingers into the pinching groove 211. Definitely, the pinching member is not limited to the pinching keys 25. In other embodiments, the pinching member may be configured to be a structure in linkage fit with the slide plate 23, for instance, an elastic sheet or a trigger.

The lower cover plate 26 is movably arranged at the outer bottom of the lower cover 22, and the lower cover plate 26 is fixedly connected with the sliding plate 23. The sealing ring 27 is fixedly sleeved on the outer edge of the lower cover plate 26. In this embodiment, the sealing ring 27 and the lower cover plate 26 are fixed in a split-type sleeving manner. Definitely, in other embodiments, the sealing ring 27 and the lower cover plate 26 may also be integrally molded. The sealing ring 27 is configured to be a necking shape from top to bottom. The lower cover 22 is provided with a squeezing portion 221, which is matched with the inner wall of the sealing ring 27 in a squeezing manner. Preferably, the squeezing portion 221 is a squeezing inclined surface arranged on the outer wall of the lower cover 22 in the circumferential direction. When the sealing ring 27 moves up along with the lower cover plate 26, the inner wall of the sealing ring 27 contacts the inclined surface. In this way, the sealing ring 27 expands, thereby sealing the inner wall of the box body 1 of the airtight box.

As shown in FIG. 2, the box cover 2 is connected to the box body 1 of the airtight box. When the pinching member is pinched, the sliding plate 23 and the lower cover plate 26 are propelled by the pinching member to move downward relative to the lower cover 22. At this point, the squeezing portion 221 releases the sealing ring 27, and the sealing ring 27 contracts under the action of its elastic force to separate from the inner wall of the box body 1 of the airtight box. Thus, the sealing ring 27 releases the box body 1, which allows the user to easily remove the box cover 2. As shown in FIG. 3, when the pinching member is released, the sliding plate 23 and the lower cover plate 26 are propelled by the reset spring 24 to move upward relative to the lower cover 22. At this point, the squeezing portion 221 starts squeezing the sealing ring 27, and the sealing ring 27 expands under the squeezing force of the squeezing portion 221. Thus, the sealing ring 27 abuts against the inner wall of the box body 1 of the airtight box, thereby realizing the sealing of the box body 1.

In this embodiment, one pinching key 25 is provided with an insertion hole 251, and the other pinching key 25 is provided with an insertion column 252 matched with the insertion hole 251. The insertion column 252 is movably inserted into the insertion hole 251. In this way, the movement of the two pinching keys 25 is effectively guided, and the pinching keys 25 are precisely positioned when being installed. Thus, the dislocation of the pinching keys 25 is avoided.

In this embodiment, a key spring 28 is arranged between the two pinching keys 25, which enables the pinching keys 25 to quickly reset when being released. Definitely, when there is no key spring 28, under the action of the reset spring 24, the pinching keys 25 can also be reset by the reverse action of the sliding plate 23 when being released.

In this embodiment, the bottom of the pinching key 25 is provided with a first inclined surface 253, and the upper surface of the sliding plate 23 is provided with a second inclined surface 231 which abuts against the first inclined surface 253. Specifically, the first inclined surfaces 253 of the two pinching keys 25 are symmetrically arranged relative to the sliding plate 23, and the two second inclined surfaces 231 are symmetrically arranged on the two sides of the sliding plate 23. When the pinching member is pinched, the two pinching keys 25 move horizontally in opposite directions, and the pinching member propels the sliding plate 23 to move downward through the interaction of the first inclined surfaces 253 and the second inclined surfaces 231.

In this embodiment, to prevent the pinching key 25 from falling, the bottom of the pinching key 25 extends into the accommodating space, and the middle portion of the pinching key 25 is provided with an avoiding groove 254 matched with the upper cover 21.

In this embodiment, to make the installation convenient, the lower cover plate 26 is provided with a clamping block 261, which passes through the lower cover 22 and is fixed with the sliding plate 23 in a clamping manner.

Embodiment 2

As shown in FIGS. 1-3, an airtight box comprises a box body 1 and a box cover 2. The box cover 2 is matched with the box body 1. When the box body 1 and the box cover 2 are connected, an annular region 3 is formed between the lower cover 22 and the box body 1. When the pinching member is pinched, the outer edge of the sealing ring 27 exits from the annular region 3. When the pinching member is released, the outer edge of the sealing ring 27 extends into the annular region 3 and abuts against the inner wall of the box body 1. In this way, the sealing ring 27 is in tight contact with the inner wall of the box body 1 such that better sealing effect is achieved.

In conclusion, the box cover of the portable airtight box of the present invention is provided with a pinching member and a sliding plate 23. The pinching member abuts against the sliding plate 23 to form a linkage structure. The lower cover plate 26 fixedly connected with the sliding plate 23 is arranged at the lower portion of the lower cover 22, the sealing ring 27 is sleeved on the outer periphery of the lower cover plate 26, and a squeezing portion 221 for squeezing the inner wall of the sealing ring 27 is arranged on the lower cover 22. During use, when the pinching member is pinched, the squeezing portion 221 releases the sealing ring 27, so that the sealing ring 27 is separated from the inner wall of the box body 1. At the point, the box cover 2 can be opened. Contrarily, when the pinching member is released, the squeezing portion 221 starts squeezing the sealing ring 27 such that the sealing ring 27 is in tight contact with the box body 1. At this point, the box body 1 is effectively sealed. Compared with the prior art, the present invention has a reasonable and simple structure and achieves low manufacturing cost, easy assembly and convenient operation.

The above are merely preferred embodiments of the present invention, and thus the equivalent changes or modifications made according to the structure, features and principles described in the specification of the present invention shall fall into the scope of the present invention.

What is claimed is:

1. A box cover for a portable airtight box, comprising:

an upper cover, a lower cover, a sliding plate, a reset spring, a pinching member, a lower cover plate, and a sealing ring, wherein the upper cover is fixedly connected to the lower cover, an accommodating space is formed between the upper cover and the lower cover, and the sliding plate is movably arranged within the accommodating space, wherein the reset spring is disposed between the sliding plate and the lower cover, wherein the sliding plate is capable of moving upward relative to the lower cover, wherein the pinching member is movably arranged on the upper cover, and the pinching member abuts against the sliding plate, wherein the lower cover plate is movably arranged at outer bottom of the lower cover, and the lower cover plate is fixedly connected with the sliding plate, wherein the sealing ring is fixedly sleeved on an outer edge of the lower cover plate, wherein the lower cover is provided with a squeezing portion which corresponds to the inner wall of the sealing ring, wherein when the pinching member is pinched, the sliding plate and the lower cover plate are propelled by the pinching member to move downward relative to the lower cover, wherein the squeezing portion stops squeezing the sealing ring at s predetermined point, thus enabling the sealing ring to separate from the inner wall of the box body of the airtight box, wherein when the pinching member is released, the sliding plate and the lower cover plate are propelled by the reset spring to move upward relative to the lower cover, wherein the squeezing portion starts squeezing the sealing ring at a predetermined point, thus making the sealing ring abut against the inner wall of the box body of the airtight box.

2. The box cover of the portable airtight box of claim 1, wherein the pinching member is a pinching key, and wherein the pinching key is horizontally and movably arranged on the upper cover.

3. The box cover of the portable airtight box of claim 2, wherein the pinching member comprises two pinching keys, and wherein the two pinching keys are oppositely arranged on the upper cover.

4. The box cover of the portable airtight box of claim 3, wherein the upper cover is provided with a pinching groove, and wherein the two pinching keys are arranged within the pinching groove.

5. The box cover of the portable airtight box of claim 3, wherein one pinching key is provided with an insertion hole, and the other pinching key is provided with an insertion column matched with the insertion hole, wherein the insertion column is movably inserted into the insertion hole.

6. The box cover of the portable airtight box of claim 3, wherein a key spring is arranged to abut between the two pinching keys.

7. The box cover of the portable airtight box of claim 2, wherein the bottom of the pinching key is provided with a first inclined surface, and wherein an upper surface of the sliding plate is provided with a second inclined surface which abuts against the first inclined surface, wherein when the pinching member is pinched, the pinching member propels the sliding plate to move downward through interaction of the first inclined surfaces and the second inclined surfaces.

8. The box cover of the portable airtight box of claim 7, wherein bottom of the pinching key extends into the accommodating space, and wherein middle portion of the pinching key is provided with an avoiding groove matched with the upper cover.

9. The box cover of the portable airtight box of claim 1, wherein the lower cover plate is provided with a clamping block, which passes through the lower cover and is fixedly connected with the sliding plate.

10. The box cover of the portable airtight box of claim 1, wherein the squeezing portion is a squeezing inclined surface arranged on the outer wall of the lower cover.

11. The box cover of the portable airtight box of claim 1, wherein the sealing ring and the lower cover plate are integrally molded.

12. The box cover of the portable airtight box of claim 1, further comprising a box body.

13. The box cover of the portable airtight box of claim 12, wherein when the box body and the box cover are connected, an annular region is formed between the lower cover and the box body, wherein when the pinching member is pinched, the outer edge of the sealing ring exits from the annular region, and wherein when the pinching member is released, the outer edge of the sealing ring extends into the annular region.

* * * * *